US009017909B2

(12) United States Patent
Ganapathiappan et al.

(10) Patent No.: US 9,017,909 B2
(45) Date of Patent: Apr. 28, 2015

(54) COATED PHOTOCONDUCTIVE SUBSTRATE

(75) Inventors: Sivapackia Ganapathiappan, Los Altos, CA (US); Krzysztof Nauka, Palo Alto, CA (US); Hou T. Ng, Campbell, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 53 days.

(21) Appl. No.: 13/459,838

(22) Filed: Apr. 30, 2012

(65) Prior Publication Data

US 2013/0288171 A1 Oct. 31, 2013

(51) Int. Cl.

| | |
|---|---|
| ***G03G 15/04*** | (2006.01) |
| ***G03G 5/043*** | (2006.01) |
| ***G03G 5/047*** | (2006.01) |
| ***G03G 5/06*** | (2006.01) |
| ***G03G 5/05*** | (2006.01) |
| ***G03G 5/087*** | (2006.01) |
| ***G03G 5/147*** | (2006.01) |
| ***G03G 9/12*** | (2006.01) |

(52) U.S. Cl.

CPC ..... *G03G 5/0675* (2013.01); *G03G 5/0535* (2013.01); *G03G 5/0546* (2013.01); *G03G 5/06* (2013.01); *G03G 5/0614* (2013.01); *G03G 5/0696* (2013.01); *G03G 5/087* (2013.01); *G03G 5/14721* (2013.01); *G03G 5/14734* (2013.01); *G03G 5/14791* (2013.01); *G03G 9/12* (2013.01)

(58) Field of Classification Search

USPC ..... 430/56, 57.1, 58.05, 58.7, 66

See application file for complete search history.

(56) References Cited

U.S. PATENT DOCUMENTS

| | | | | |
|---|---|---|---|---|
| 5,476,604 | A | 12/1995 | Nguyen et al. | |
| 6,902,857 | B2 | 6/2005 | Yagi et al. | |
| 2005/0287452 | A1 | 12/2005 | Tamura et al. | |
| 2006/0286473 | A1* | 12/2006 | Kami | 430/58.85 |
| 2007/0042281 | A1* | 2/2007 | Orito et al. | 430/59.5 |
| 2007/0117033 | A1* | 5/2007 | Sugino et al. | 430/58.7 |
| 2009/0035672 | A1 | 2/2009 | Yanagawa et al. | |
| 2010/0215405 | A1* | 8/2010 | Patton et al. | 399/237 |
| 2011/0200926 | A1 | 8/2011 | Tanaka et al. | |
| 2012/0021346 | A1 | 1/2012 | Nagayama et al. | |

* cited by examiner

*Primary Examiner* — Thorl Chea

(74) *Attorney, Agent, or Firm* — Thorpe, North & Western L.L.P.

(57) ABSTRACT

The present disclosure is drawn to electrostatic printing. In an example, a coated photoconductive substrate can comprise a photoconductive substrate, the photoconductive substrate including a substrate having a charge generation layer and charge transport layer adhered thereto; and a top coating adhered to the photoconductive substrate. The top coating can comprise a cross-linkable polymer, a cross-linker, and a charge transport material, where the charge transport material is dispersed throughout the top coating and may be present in the top coating in an amount ranging from 20 wt % to 50 wt %.

19 Claims, 4 Drawing Sheets

COATED PHOTOCONDUCTIVE SUBSTRATE

BACKGROUND

In many printing systems, it is common practice to develop a hardcopy of an image (e.g. on paper or other print substrate) by using a photoconductive substrate. The photoconductive substrate is selectively charged with a latent electrostatic image having image and background areas. For example, a liquid developer comprising charged toner particles in a carrier liquid can be brought into contact with the surface of the selectively charged photoconductive substrate. The charged toner particles adhere to the image areas of the latent image while the background areas remain clean. The hardcopy material is brought directly or indirectly into contact with the photo-conductive surface in order to transfer the latent image. Variations of this method utilize different ways for forming the electrostatic latent image on a photoreceptor or on a dielectric material.

BRIEF DESCRIPTION OF THE DRAWINGS

Additional features and advantages of the invention will be apparent from the detailed description which follows, taken in conjunction with the accompanying drawings, which together illustrate, by way of example, features of the invention.

Figure 1:
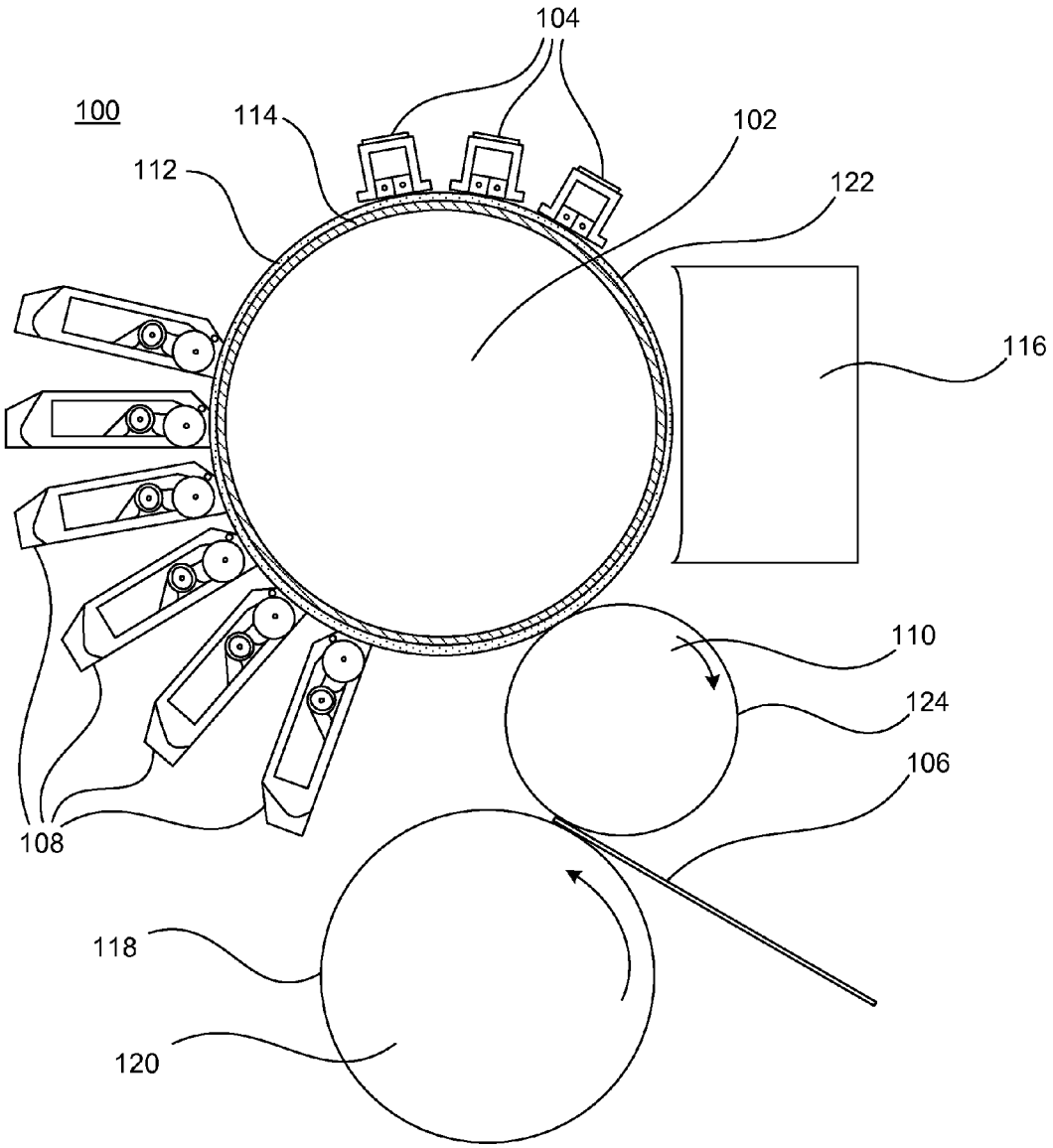
FIG. 1 is a general schematic of one possible print engine from a liquid electrophotographic printer in accordance with one example of the present disclosure.

Reference will now be made to the exemplary embodiments illustrated, and specific language will be used herein to describe the same. It will nevertheless be understood that no limitation of the scope of the invention is thereby intended.

DETAILED DESCRIPTION

Before the present invention is disclosed and described, it is to be understood that this disclosure is not limited to the particular process steps and materials disclosed herein because such process steps and materials may vary somewhat. It is also to be understood that the terminology used herein is used for the purpose of describing particular embodiments only. The terms are not intended to be limiting because the scope of the present invention is intended to be limited only by the appended claims and equivalents thereof.

It has been recognized that it would be advantageous to develop a photoconductive substrate having extended life in printing systems. In accordance with this, the present disclosure is drawn to coated photoconductive substrates, as well as associated methods involving such coatings. Notably, it has been discovered that the coating of existing photoconductors in printing systems with a cross-linkable polymer and a charge transport material extends the life of the photoconductor while preserving the functionality and performance of the latent image former. Additionally, it has been discovered that such coated photoconductive substrates can be used in conjunction quite effectively with liquid electrophotographic (LEP) printing inks.

It is noted that when discussing a coated photoconductive substrate or a method of extending the life of a photoconductive substrate, each of these discussions can be considered applicable to the other embodiment, whether or not they are explicitly discussed in the context of that embodiment. Thus, for example, in discussing a coating for a coated photoconductive substrate, such a coating can also be used in a method of extending the life of a photoconductive substrate, and vice versa.

Thus, a coated photoconductive substrate can comprise a photoconductive substrate and a top coating adhered to the photoconductive substrate. Generally, the photoconductive substrate includes a substrate having a charge generation layer and charge transport layer adhered thereto. Additionally, the top coating comprises a cross-linkable polymer, a cross-linker, and a charge transport material. The charge transport material can be dispersed throughout the top coating and can be present in the top coating in an amount ranging from 20 wt % to 50 wt %. Alternatively or additionally, the coating provides a $V_{light}$ of less than 200 after 1,000 printed images. In one example, the photoconductive substrate can be a photo imaging plate in a liquid electrophotographic printer.

Generally, the coatings described herein comprise a cross-linkable polymer and a charge transport material. Regarding the cross-linkable polymer, such a polymer generally comprises polymerized monomers with at least one monomer having cross-linkable functionality. The cross-linkable polymer is generally polymerized from monomers, also refers to as "polymerized monomers." In one example, the polymerized monomers can be selected from acrylates, methacrylates, styrenes, vinyl monomers, combinations thereof, and mixtures thereof. In one aspect, the cross-linkable polymer can comprise a polymerized monomer selected from the group of methyl methacrylate, butyl acrylate, butyl methacrylate, hexyl acrylate, hexyl methacrylate, 2-ethylhexyl acrylate, 2-ethylhexyl methacrylate, lauryl acrylate, lauryl methacrylate, octadecyl acrylate, octadecyl methacrylate, stearyl methacrylate, acrylic acid, methacrylic acid, acrylonitrile, methacrylonitrile, styrene, methylstyrene, combinations thereof, and mixtures thereof. In one example, the cross-linkable polymer can be a copolymer. In one aspect, the cross-linkable polymer can be a polystyrene copolymer. As also discussed herein, the cross-linkable polymer comprises at least one monomer having cross-linking functionality. Such a cross-linker typically reacts with functional groups on cross-linkable monomers from the same or two discrete polymer strands. In one example, the cross-linker can be selected from the group of polyisocyanates, polyols, polyesters, polyamines, combinations thereof, and mixtures thereof. The cross-linker can be present in the coating from 0.01 wt % to 10 wt % in the dried coating composition and the cross-linkable polymer can be present in the coating in an amount of 50 wt % to 99.9 wt % by solids.

The charge transport material is also generally included in the coating and can include those described herein. In one example, the charge transport material can be an aromatic tertiary amine selected from the group of tri-p-tolylamine (PTA), N,N'-bis(3-methylphenyl)-N,N'-diphenylbenzidine (TBD), 4,4'-N,N,N',N'-tetraphenylbenzidine, triphenylamine, and mixtures thereof. In one example, the coating can comprise 20 wt % to 50 wt % of charge transport material based on the weight of the cross-linkable polymer. In another aspect, the coating can comprise 20 wt % to 40 wt % charge transport material based on the weight of the cross-linkable polymer, and in another aspect, 25 wt % to 35 wt % charge transport material based on the weight of the cross-linkable polymer. The charge transport material can be added in the coating at any time during the preparation process.

Generally, the present coatings can be used with any type of photoconductive substrates in printing systems, e.g., organic photoconductors. As such, the coated photoconductive substrates generally comprise a charge generation layer and a charge transport layer. The charge generation layer can comprise charge generation materials. The charge generating materials may be classified into inorganic materials and organic materials and both are suitable for use. Examples of inorganic materials include crystalline selenium, amorphous selenium, selenium-tellurium, selenium-tellurium-halogen, selenium-arsenic compound, and amorphous silicon. The amorphous silicon may have dangling bonds terminated with hydrogen atom or a halogen atom, or it may be doped with boron or phosphorus. The organic material may be selected from conventional materials, and examples thereof include phthalocyanine pigments such as metal phthalocyanine, non-metal phthalocyanine, azulenium salt pigments, aquatic acid methine pigment, azo pigments having a carbazole skeleton, azo pigments having a triphenylamine skeleton, azo pigments having diphenylamine skeleton, azo pigments having dibenzothiophene skeleton, azo pigments having fluorenone skeleton, azo pigments having oxadiazole skeleton, azo pigments having bisstylbene skeleton, azo pigments having distyryl oxidiazole skeleton, azo pigments having distyrylcarbazole skeleton, perylene pigments, anthraquinone or polycyclic quinone pigments, quinone imine pigments, diphenylmethane pigments, triphenylmethane pigments, benzoquinone pigments, naphtoquinone pigments, cyanine pigments, azomethine pigments, indigoido pigments, or bisbenzimidazole pigments. These charge generating materials may be used alone or in combination.

Additionally, the charge transport layer can comprise hole transport substances and electron transport substances. Examples of electron transport materials include electron-accepting substances such as chloroanil, bromoanil, tetracyanoethylene, tetracyano quinodimethane, 2,4,7-trinitro-9-fluorenone, 2,4,5,7-tetranitro-9-fluorenone, 2,4,5,7-tetranitroxanthone, 2,4,8-trinitrothioxanthone, 2,6,8-trinitro-4H-indino[1,2-b]thiophene-4-on, 1,3,7-trinitrodibenzothiophene-5,5-dioxide, and diphenoquinones. These electron transport substances may be used alone or in combination. Examples of hole transporting substances include oxazoles, oxadiazoles, imidazoles, monoarylamines, diarylamines, triarylamines, stilbenes, α-phenyl stilbenes, benzidines, diarylmethanes, triarylmethanes, 9-styrylanthracenes, pyrazolines, divinyl benzenes, hydrazones, indenes, butadienes, pyrenes, bisstylbenes, enamines, and aromatic tertiary amines. These hole transporting substances may be used alone or in combination. In some examples, the photoconductive substrates can include a single layer comprising charge generation materials and charge transport materials.

Generally, the coating can have a thickness of 0.1 μm to 5 μm. In one example, the coating can have a thickness of 1 μm to 2 μm. The coatings can be used with photoconductive substrates and still provide acceptable $V_{light}$. As used herein, "$V_{light}$" refers to the measured voltage between a front site and a grounded back site of the photoconductive substrate in LEP printing systems after illumination causes controlled neutralization of the electrical charges from the front side of the photoconductive substrate. In one example, the coating can provide a $V_{light}$ of less than 200 V after 1,000 printed images. In one aspect, the coating can provide a $V_{light}$ of less than 150 V after 1,000 printed images.

The ink application device can comprises a photo imaging plate for forming an electrostatic image, and a charging unit configured to charge at least a portion of the photo imaging plate forming a latent image. The device can further comprise a binary image developer for applying a liquid toner or liquid electrophotographic ink to the latent image forming a developed image, an intermediate transfer member that receives the developed image, and an impression roller having a substrate that receives the developed image from the intermediate transfer member.

Thus, a coated photoconductive substrate can comprise a substrate having a charge generation layer adhered thereto, a charge transport layer adhered to the charge generation layer, and a top coat adhered to the charge transport layer. The top coat generally comprises a cross-linkable polymer, a cross-linker, and a charge transport material as discussed herein. While the present figure provides a specific structure of the photoconductive substrate, it is understood that the illustrated structure is not intended to be limiting and that the present disclosure contemplates the use of the present top coat with any number of photoconductive substrates. For example, the present top coat can be applied to a photoconductive substrate that has a single layer that include charge generation materials and charge transport materials.

Referring to FIG. 1, a liquid electrophotographic (LEP) print engine 200 is shown in accordance with one example of the present disclosure. It is noted that the elements of FIG. 1 are not necessarily drawn to scale, nor does it represent every photoconductive printing system available for use herein, i.e. it provides merely an exemplary embodiment of one photoconductive printing system. In this example, the LEP print engine can form a latent image on a photo imaging plate (PIP) 202 by charging at least a portion of the PIP with charging units 204. The charging mechanism can include one or multiple unit charging subunits (not shown) followed by a laser discharging unit (not shown). Typically, the charging of the PIP corresponds to an image which can be printed by the LEP printing engine on a substrate 206. The latent image can be developed by liquid toner/liquid electrophotographic ink from binary image developers (BID) 208. The liquid electrophotographic ink adheres to the appropriately charged areas of the PIP developing the latent image thereby forming a developed image. The developed image can be transferred to an intermediate transfer member (ITM) 210. Additionally, the developed image can be heated on the ITM. The developed image can then be transferred to a substrate as described herein.

The PIP can have a coating 212 directly applied thereto or can be applied to charge generation and charge transport layers 214 that is applied to the PIP, as shown in FIG. 1. The PIP can be optionally discharged and cleaned by a cleaning/discharging unit 216 prior to recharging of the PIP in order to start another printing cycle. As the substrate passes by the ITM, the developed image located on the ITM can then be transferred to the substrate. Affixation of the developed image to the substrate can be facilitated by locating the substrate on the surface 218 of impression roller 220, which can apply pressure to the substrate by compressing it between the impression roller and the ITM as the image is being transferred to the substrate. Eventually, the substrate bearing the image exits the printer. In one embodiment, the printer can be a sheet-fed printer. In another embodiment, the printer can be a web-fed printer.

FIG. 1 shows a plurality of BID units located on the PIP. In one example, each BID can contain a different colored liquid electrophotographic ink for use in producing multi-color images. Generally, a colored liquid electrophotographic ink can be located in each of the other BID units. The present LEP printer can be a 1-shot process printer that transfers a complete multi-color image to the substrate at one time. For example, if an image is comprised of four color separations (e.g., black, cyan, magenta, and yellow), an exemplary mode of operation could involve charging the PIP with the appropriate pattern for the yellow electrophotographic ink. As the PIP rotates, the BID that contains yellow liquid electrophotographic ink can apply the toner onto the coated PIP surface 222, developing the latent image. The yellow electrophotographic ink image can then be transferred to the ITM surface 224 where it remains, awaiting the deposit of the remaining color layers, i.e. cyan, magenta and black. This cycle can be repeated for each of the remaining colors until a complete multi-colored image is located on ITM. Once the complete image is assembled, it can be deposited all at once onto the substrate. In another embodiment, the LEP printer can transfer each colored liquid electrophotographic ink to the substrate sequentially. Additionally, the LEP printer can include a BID that contains only a wetting substance, such as a carrier liquid used in the liquid electrophotographic ink, for example, or a volatile component thereof such as ISOPAR® L, to improve streaking.

The liquid electrophotographic inks or liquid toners described herein can be any such ink or toners known in the art, including liquid electrophotographic inks that comprise a liquid vehicle, a colorant, a charging component, and optionally, polymer(s). Additionally, other additive may be present in the liquid toner. One or more non-ionic, cationic, and/or anionic surfactant can be present, ranging from 0.01 wt % to 5.0 wt %, if present. The balance of the formulation can comprise other liquid vehicle components known in the art, such as biocides, organic solvents, viscosity modifiers, pH adjusters, sequestering agents, preservatives, compatibility additives, emulsifiers, and the like.

Additionally, a method of extending the life of a photoconductive substrate can comprise applying a top coating to the photoconductive substrate. The photoconductive substrate generally includes a substrate having a charge generation layer and charge transport layer adhered thereto; where the top coating comprises a cross-linkable polymer, a cross-linker, and a charge transport material and where the charge transport material is dispersed throughout the top coating. In one example, the photoconductive substrate can be a photo imaging plate in a liquid electrophotographic printer. In another example, the top coating can be heated to cross-link the cross-linkable polymer. Such heating can be performed in the range of 50° C. to 200° C. In one aspect the heating can be from 70° C. to 120° C.

Notably, it has thus been discovered that thin coating layers described herein can improve the shelf-life of conductive substrates without affecting the $V_{light}$ for conductivity. Additionally, the coatings do not affect or substantially affect any underlying layer of coatings, including charge generation or charge transport layers. Further, the coatings can improve scratch resistance. As such, the present coatings can extend the life of a photoconductive substrate, including those used in LEP applications.

It is noted that, as used in this specification and the appended claims, the singular forms "a," "an," and "the" include plural referents unless the context clearly dictates otherwise.

As used herein, "liquid electrophotographic ink" or "liquid toner" generally refers to an ink having a liquid vehicle, a colorant, a charging component, and polymer(s) used in electrophotographic printing.

As used herein, "liquid electrophotographic printing," "LEP," or "electrostatic printing" generally refers to the process that provides a liquid electrophotographic ink or ink toner image that is electrostatically transferred from a photo imaging plate to an intermediate drum or roller, and then thermally transferred to a substrate, or to the process wherein the ink image is electrostatically transferred from the photo imaging plate directly onto a substrate. Additionally, "liquid electrophotographic printers" generally refer to those printers capable of performing electrophotographic printing, as described above. These types of printers are different than traditional electrophotographic printers that utilized essentially dry charged particles to image a media substrate.

As used herein, "photoconductive substrate" refers to any substrate for transferring of inks used in the imaging of photoconductive materials including LEP printing. In one embodiment, the photoconductive substrate can be a photo imaging plate of an LEP printer.

As used herein, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary.

Concentrations, amounts, and other numerical data may be expressed or presented herein in a range format. It is to be understood that such a range format is used merely for convenience and brevity and thus should be interpreted flexibly to include not only the numerical values explicitly recited as the limits of the range, but also to include all the individual numerical values or sub-ranges encompassed within that range as if each numerical value and sub-range is explicitly recited. As an illustration, a numerical range of "about 1 wt % to about 5 wt %" should be interpreted to include not only the explicitly recited values of about 1 wt % to about 5 wt %, but also include individual values and sub-ranges within the indicated range. Thus, included in this numerical range are individual values such as 2, 3.5, and 4 and sub-ranges such as from 1-3, from 2-4, and from 3-5, etc. This same principle applies to ranges reciting only one numerical value. Furthermore, such an interpretation should apply regardless of the breadth of the range or the characteristics being described.

EXAMPLES

The following examples illustrate embodiments of the disclosure that are presently known. Thus, these examples should not be considered as limitations of the invention, but are merely in place to teach how to make compositions of the present disclosure. As such, a representative number of compositions and their method of manufacture are disclosed herein.

Example 1

Preparation of Polymer for Coating

Styrene (98.8 g) was mixed with 2-hydroxyethyl methacrylate (6.51 g) and azobisisobutyronitrile (5 mg). This mixture was degassed with nitrogen and heated to 70° C. for 17 hours, at 85° C. for 28.5 hours, at 100° C. for 48 hours and at 115° C. for 22 hours. The resultant polymer was dissolved in tetrahydrofuran (1.8 L) and precipitated in heptanes (8 L). The precipitated polymer was collected, dried and dissolved in dichloromethane (2 kG), and precipitated in heptanes (8 L). The precipitated polymer was collected and dried at 85° C. in a vacuum oven. A 10% polymer solution was prepared by dissolving 4.545 g in toluene (40.905 g). Weight average molecular weight of this polymer was found to be 908K and number average molecular weight was found to be 322K.

Example 2

Formulation of Coating for Photoconductive Substrate

Five formulations were prepared with PTA and TBD as shown in Table 1 below.

TABLE 1

| | Components | | | | | |
|---|---|---|---|---|---|---|
| Formulation # | PTA (g) | TBD (g) | 10% TDI in Toluene (g) | 1% DBTDL in Toluene (g) | Toluene (g) | Polymer from Example 1 in Toluene (g) |
| 1 | — | 0.45 | 0.33 | 0.012 | 19.308 | 9.9 |
| 2 | — | 0.6 | 0.282 | 0.012 | 5.667 | 8.439 |
| 3 | — | 0.675 | 0.266 | 0.012 | 6.063 | 7.984 |
| 4 | 0.6 | — | 0.282 | 0.012 | 5.667 | 8.439 |
| 5 | 0.675 | — | 0.266 | 0.012 | 6.063 | 7.984 |

PTA—tri-p-tolylamine
TBD—N,N'-bis(3-methylphenyl)-N,N'-diphenylbenzidine
TDI—tolylenediisocyanate
DBTDL—dibutyltindilaurate

Example 3

Coated Photoconductive Substrates

The formulations of Table 1 were coated onto PIPs of LEP printers using a drawing wire roller to form a thin coating of 0.5 microns (after solvent evaporated). In addition, the coated photoconductor was annealed at 90° C. for 1 hour to remove any residual solvent. Afterwards, the coated photoconductor was used to print a test pattern where $V_{light}$ was measured during the printing. The coatings allowed for proper charge transport during printing. Table 2 provides $V_{light}$ as a function of TBD charge transport material (CTM) concentration within dry coating film (the same coating thickness of approx. 5 microns).

TABLE 2

| CTM (TDB) (%) | 10 | 20 | 30 | 40 |
|---|---|---|---|---|
| $V_{light}$ (V) | 588 | 344 | 138 | 146 |

Figure 2:
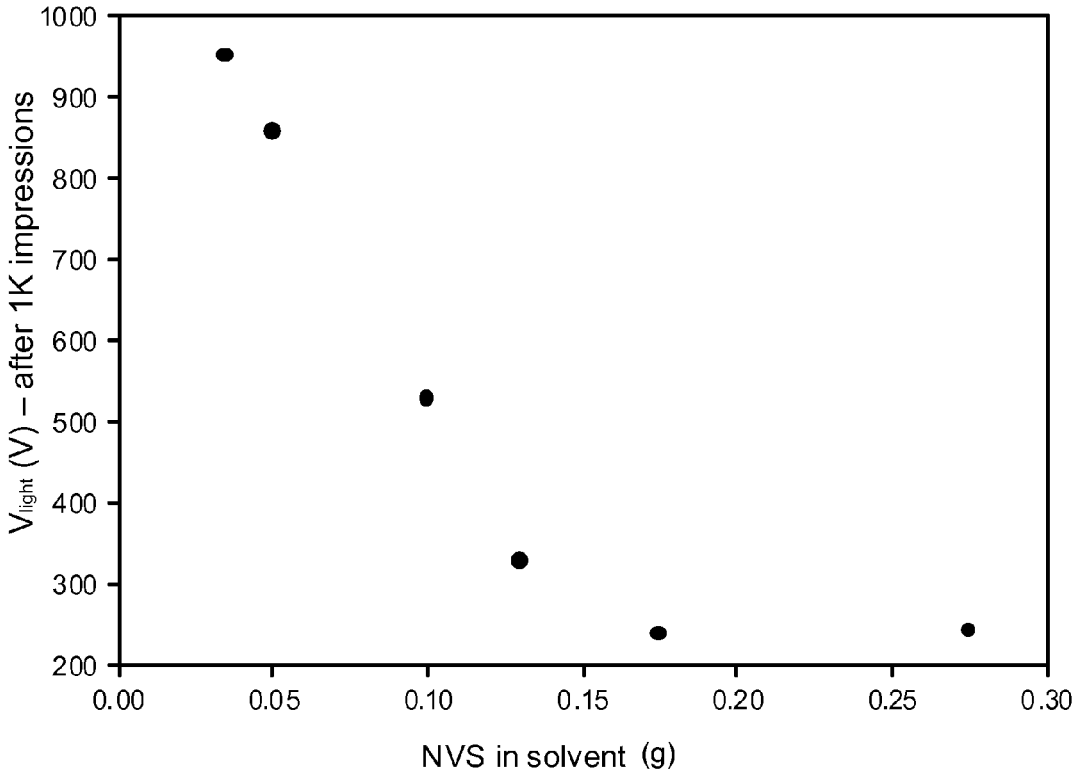
FIG. 2 is a graph of $V_{light}$ vs. weight of non-volatile solids in solution after 1,000 impressions in accordance with certain examples of the present disclosure.

As shown in Table 2, the $V_{light}$ unexpectedly provided a minimum between 20% and 40% CTM. FIG. 2 provides a measurement of NVS vs $V_{light}$ for coating #3 having the same concentration of the charge transport material while varying the amount of NVS present in the coating. Notably, toluene did not degrade the photoconductive substrate as the coating had sufficient viscosity. In one example, the viscosity can range from 5 cps to 5000 cps. In another aspect, the viscosity can range from 6 cps to 600 cps, and in another aspect, can range from 7 cps to 100 cps.

Example 4

Loading Effect of Charge Transport Material

Figure 3:
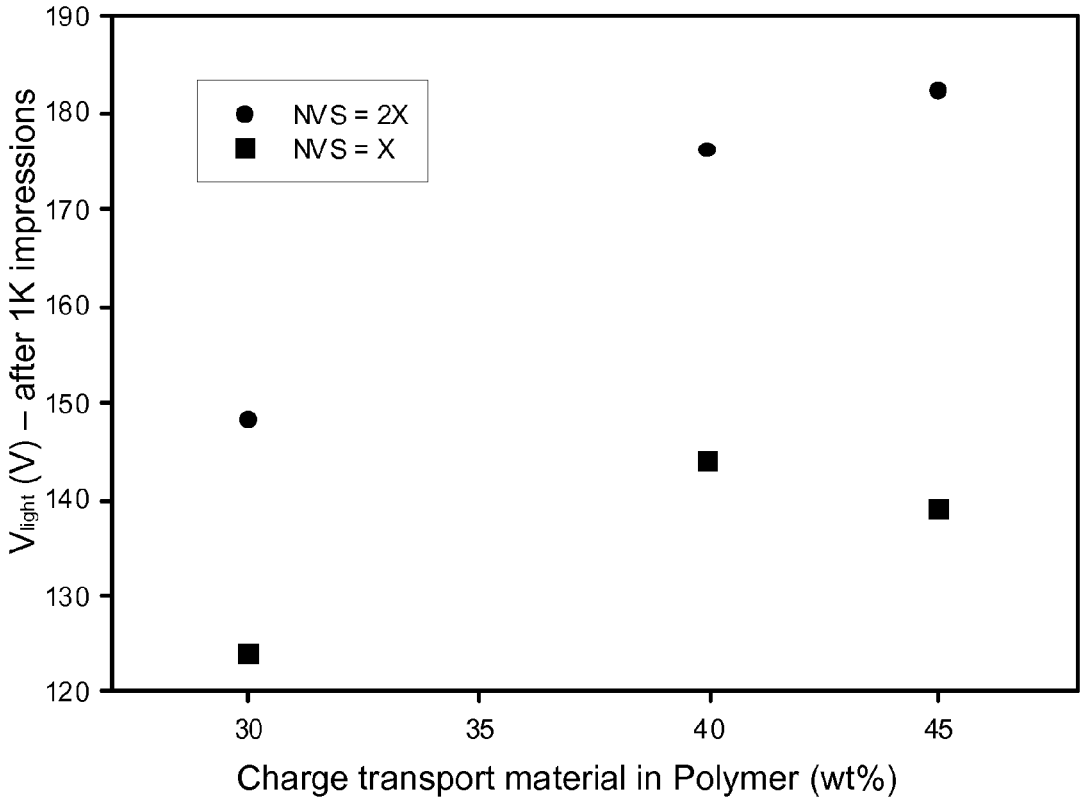
FIG. 3 is a graph of $V_{light}$ after 1,000 impressions vs. cross-linkable polymer to charge transport material ratio for two different coatings in accordance with certain examples of the present disclosure.

The effect of loading of charge transport material was also measured against $V_{light}$ values and found that the loading of 30% of charge transport material in the polymer yields the lowest $V_{light}$ values. This is illustrated in FIG. 3. Notably, increasing the charge transport material (>50 wt % in the polymer) also lowers the film strength of the coating as the cohesive forces between polymer chains is considerably weakened.

Example 5

Scratch Resistance of Coated Photoconductive Substrates

Figure 4:
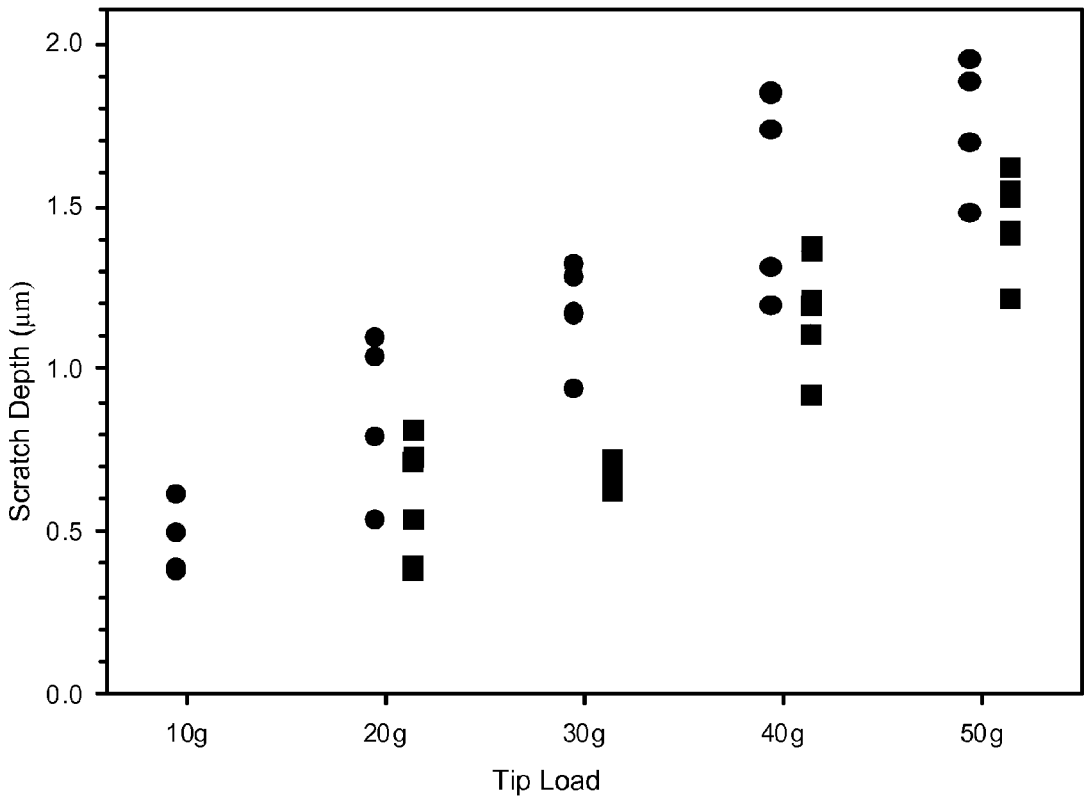
FIG. 4 is a graph of scratch depth vs. tip load for various surfaces of photoconductive substrates in accordance with certain examples of the present disclosure.

Scratch resistance was obtained for 30 wt % CTM coated photoconductor from FIG. 3 and an uncoated photoconductor measured with a Taber scratch tester. The results are shown in FIG. 4, which compares scratch depths (μm) for a different weight loading of the scratching diamond tip: circles—uncoated, squares—coated. As shown in FIG. 4, the present coated photoconductors provided increased scratch resistance as compared to uncoated photoconductors.

Example 6

Formulations of Coating for Photoconductive Substrate

Five formulations can be prepared with PTA and TBD as shown in Table 3 below, where the polymer in formulation #1 is a copolymer of styrene and 1,2-ethylene diamine, the polymer in formulation #2 is a copolymer of methyl methacrylate and 2-hydroxypropyl acrylate, the polymer in formulation #3 is a copolymer of butyl acrylate and 2-hydroxyethyl methacrylate, the polymer in formulation #4 is a copolymer of acrylic acid and 2-hydroxyethyl methacrylate, and the polymer in formulation #5 is a copolymer of 2-ethylhexyl acrylate and 1,3-propylene diamine. In each of formulations 6-10, an appropriate solvent can be included at from about 4 to 25 grams so that the solids can be coated on the photoconductive substrate. However, the solvent will typically be removed upon formation the top coating layer.

TABLE 3

| Formulation # | PTA (g) | TBD (g) | 10% TDI in Toluene (g) | 1% DBTDL in Toluene (g) | Polymer (g) |
|---|---|---|---|---|---|
| 6 | — | 0.5 | 0.3 | 0.012 | 10 |
| 7 | — | 0.5 | 0.3 | 0.012 | 10 |
| 8 | — | 0.5 | 0.3 | 0.012 | 10 |
| 9 | 0.75 | — | 0.3 | 0.012 | 10 |
| 10 | 0.75 | — | 0.3 | 0.012 | 10 |

PTA—tri-p-tolylamine
TBD—N,N'-bis(3-methylphenyl)-N,N'-diphenylbenzidine
TDI—tolylenediisocyanate
DBTDL—dibutyltindilaurate While the invention has been described with reference to certain preferred embodiments, those skilled in the art will appreciate that various modifications, changes, omissions, and substitutions can be made without departing from the spirit of the invention. It is intended, therefore, that the invention be limited only by the scope of the following claims.

What is claimed is:

1. A coated photoconductive substrate, comprising:

a photoconductive substrate including a substrate having a charge generation layer and charge transport layer adhered thereto; and a top coating adhered to the photoconductive substrate, the top coating comprising a cross-linkable polymer, a cross-linker, and a charge transport material, wherein the charge transport material is dispersed throughout the top coating and is present in the top coating in an amount ranging from 20 wt % to 50 wt %;

wherein the top coating has a thickness of 0.1 μm to 5 μm and wherein the coated photoconductive substrate provides a $V_{light}$ of less than 200 after 1,000 printed images.

2. The coated photoconductive substrate of claim 1, wherein the photoconductive substrate is a photo imaging plate in a liquid electrophotographic printer.

3. The coated photoconductive substrate of claim 1, wherein the cross-linkable polymer comprises polymerized monomers selected from acrylates, methacrylates, styrenes, vinyl monomers, combinations thereof, and mixtures thereof.

4. The coated photoconductive substrate of claim 1, wherein the cross-linkable polymer comprises a polymerized monomer selected from the group of methyl methacrylate, butyl acrylate, butyl methacrylate, hexyl acrylate, hexyl methacrylate, 2-ethylhexyl acrylate, 2-ethylhexyl methacrylate, lauryl acrylate, lauryl methacrylate, octadecyl acrylate, octadecyl methacrylate, stearyl methacrylate, acrylic acid, methacrylic acid, acrylonitrile, methacrylonitrile, styrene, methylstyrene, combinations thereof, and mixtures thereof.

5. The coated photoconductive substrate of claim 1, wherein the cross-linkable polymer is a polystyrene copolymer.

6. The coated photoconductive substrate of claim 1, wherein the cross-linker is selected from the group of polyisocyanates, polyols, polyesters, polyamines, combinations thereof, and mixtures thereof.

7. The coated photoconductive substrate of claim 1, wherein the charge transport material is an aromatic tertiary amine selected from the group of tri-p-tolylamine (PTA), N,N'-bis(3-methylphenyl)-N,N'-diphenylbenzidine (TBD), 4,4'-N,N,N',N'-tetraphenylbenzidine, triphenylamine, and mixtures thereof.

8. The coated photoconductive substrate of claim 1, wherein the coating comprises 20 wt % to 40 wt % of charge transport material based on the weight of the cross-linkable polymer.

9. The coated photoconductive substrate of claim 1, wherein the coating comprises 25 wt % to 35 wt % of charge transport material based on the weight of the cross-linkable polymer.

10. The coated photoconductive substrate of claim 1, wherein the charge generation layer comprises charge generation materials selected from the group of crystalline selenium, amorphous selenium, selenium-tellurium, selenium-tellurium-halogen, selenium-arsenic compound, amorphous silicon, phthalocyanine pigments, metal phthalocyanine, non-metal phthalocyanine, azulenium salt pigments, aquatic acid methine pigment, azo pigments having a carbazole skeleton, azo pigments having a triphenylamine skeleton, azo pigments having diphenylamine skeleton, azo pigments having dibenzothiophene skeleton, azo pigments having fluorenone skeleton, azo pigments having oxadiazole skeleton, azo pigments having bisstylbene skeleton, azo pigments having distyryl oxidiazole skeleton, azo pigments having distyrylcarbazole skeleton, perylene pigments, anthraquinone quinone pigments, polycyclic quinone pigments, quinone imine pigments, diphenylmethane pigments, triphenylmethane pigments, benzoquinone pigments, naphtoquinone pigments, cyanine pigments, azomethine pigments, indigoido pigments, bisbenzimidazole pigments, and mixtures thereof.

11. The coated photoconductive substrate of claim 1, wherein the charge transport layer comprises charge transport materials selected from the group of chloroanil, bromoanil, tetracyanoethylene, tetracyano quinodimethane, 2,4,7-trinitro-9-fluorenone, 2,4,5,7-tetranitro-9-fluorenone, 2,4,5,7-tetranitroxanthone, 2,4,8-trinitrothioxanthone, 2,6,8-trinitro-4H-indino[1,2-b]thiophene-4-on, 1,3,7-trinitrodibenzothiophene-5,5-dioxide, diphenoquinones, oxazoles, oxadiazoles, imidazoles, monoarylamines, diarylamines, triarylamines, stilbenes, α-phenyl stilbenes, benzidines, diarylmethanes, triarylmethanes, 9-styrylanthracenes, pyrazolines, divinyl benzenes, hydrazones, indenes, butadienes, pyrenes, bisstylbenes, enamines, aromatic tertiary amines, and mixtures thereof.

12. A method of extending the life of a photoconductive substrate, comprising applying a top coating to the photoconductive substrate, the photoconductive substrate including a substrate having a charge generation layer and charge transport layer adhered thereto; wherein the top coating comprises a cross-linkable polymer, a cross-linker, and a charge transport material and wherein the charge transport material is dispersed throughout the top coating.

13. The method of claim 12, wherein the photoconductive substrate is a photo imaging plate in a liquid electrophotographic printer.

14. The method of claim 12, wherein the top coating is heated to cross-link the cross-linkable polymer.

15. A coated photoconductive substrate, comprising:

a photoconductive substrate including a substrate having a charge generation layer and charge transport layer adhered thereto; and a top coating adhered to the photoconductive substrate, the top coating comprising a cross-linkable polymer, a cross-linker, and a charge transport material, wherein the charge transport material is dispersed throughout the top coating and at a concentration wherein the coated photoconductive substrate provides a $V_{light}$ of less than 200 after 1,000 printed images.

16. The coated photoconductive substrate of claim 15, wherein the charge transport material is dispersed throughout the top coating and is present in the top coating in an amount ranging from 20 wt % to 50 wt %.

17. The coated photoconductive substrate of claim 15, wherein the coating comprises 25 wt % to 35 wt % of charge transport material based on the weight of the cross-linkable polymer.

18. The coated photoconductive substrate of claim 15, wherein the photoconductive substrate is a photo imaging plate in a liquid electrophotographic printer.

19. The coated photoconductive substrate of claim 16, wherein the cross-linkable polymer is a polystyrene copolymer and the charge transport material is an aromatic tertiary amine selected from the group of tri-p-tolylamine (PTA), N,N'-bis(3-methylphenyl)-N,N'-diphenylbenzidine (TBD), 4,4'-N,N,N',N'-tetraphenylbenzidine, triphenylamine, and mixtures thereof.

* * * * *